US007839341B2

(12) United States Patent
Seo

(10) Patent No.: US 7,839,341 B2
(45) Date of Patent: Nov. 23, 2010

(54) ANTENNA AND MOBILE TERMINAL USING THE SAME

(75) Inventor: Dong Kyu Seo, Ulsan-si (KR)

(73) Assignee: LG Electronics, Inc., Seoul (KR)

( * ) Notice: Subject to any disclaimer, the term of this patent is extended or adjusted under 35 U.S.C. 154(b) by 713 days.

(21) Appl. No.: 11/774,161

(22) Filed: Jul. 6, 2007

(65) Prior Publication Data

US 2008/0007467 A1 Jan. 10, 2008

(30) Foreign Application Priority Data

Jul. 7, 2006 (KR) ..... 10-2006-0063805

(51) Int. Cl.
*H01Q 1/24* (2006.01)

(52) U.S. Cl. ..... 343/702

(58) Field of Classification Search ..... 343/700 MS, 343/702, 846

See application file for complete search history.

(56) References Cited

U.S. PATENT DOCUMENTS 6,285,327 B1 * 9/2001 See ..... 343/702
6,603,430 B1 8/2003 Hill et al.
2002/0075189 A1 * 6/2002 Carillo et al. ..... 343/702
2002/0135523 A1 * 9/2002 Romero et al. ..... 343/741
2004/0246180 A1 12/2004 Okado
2005/0190108 A1 9/2005 Lin et al.
2008/0055046 A1 * 3/2008 Shimizu ..... 340/10.1
2008/0117027 A1 * 5/2008 Tsirline et al. ..... 340/10.6

FOREIGN PATENT DOCUMENTS

EP 1168495 1/2002

* cited by examiner

*Primary Examiner*—Huedung Mancuso
(74) *Attorney, Agent, or Firm*—Lee, Hong, Degerman, Kang & Waimey

(57) ABSTRACT

An antenna and a mobile terminal using the same is provided. The mobile terminal according to an aspect of the present invention includes a shielding unit and an antenna comprising a feed unit and a ground unit formed over the shielding unit, a first pattern connected to a top surface of the feed unit and the ground unit and isolated from the shielding unit, and a second pattern connected to a first end of the first pattern and having an open end formed close to a portion of the first pattern second end connected to the ground unit. The first pattern has a high frequency band characteristic, and the second pattern has a low frequency band characteristic.

20 Claims, 4 Drawing Sheets

ANTENNA AND MOBILE TERMINAL USING THE SAME

CROSS-REFERENCE TO RELATED APPLICATION

Pursuant to 35 U.S.C. §119(a), this application claims the benefit of earlier filing date and right of priority to Korean Application No. 10-2006-0063805 filed on Jul. 7, 2006, the entire contents of which are hereby incorporated by reference.

FIELD OF THE INVENTION

The present invention is directed to an antenna and a mobile terminal using the same.

DESCRIPTION OF THE RELATED ART

In general, an antenna is means for receiving electric waves introduced from the outside and transmitting signals, received from other internal units, to the outside. The antenna is an indispensable component in a wireless communication device, i.e., a mobile terminal. The antenna serves as a medium when transmitting and receiving signals with a base station, thus improving the signal quality. In the antenna, there is a tendency that resonance structures resonating in respective bands are separated from each other when being designed in a multi-band.

However, in recent years, there is a tendency that mobile terminals have numerous components built therein, and have become miniaturized or slim. Accordingly, there is a case where a distance between the antenna and several components is not sufficient. In this case, in order to protect circuits within the mobile terminal from the antenna or to protect the antenna from circuit noise, shielding walls are used.

When the shielding walls are adjacent to each other, a specific band is located close to the shielding wall in a structure in which multiple bands are separated from each other in order to improve the characteristics of the antenna itself.

This antenna structure is problematic in that a total effective radiation output is low because a part of the effective radiation is absorbed by the shielding walls when the antenna is active.

SUMMARY OF THE INVENTION

In one aspect of the present invention a mobile terminal is provided, the mobile terminal includes a shielding unit, and an antenna comprising a feed unit and a ground unit formed over the shielding unit, a first pattern having a first end connected to top a surface of the feed unit and a second end connected to the ground unit and isolated from the shielding unit, and the second pattern connected to a first end of the first pattern and having an open end formed close to a second end of the first pattern, wherein the first pattern has a high frequency band characteristic, and the second pattern has a low frequency band characteristic.

It is contemplated that a current applied from the feed unit of the antenna flows through the first pattern in a loop structure to the ground unit. It is further contemplated that the first pattern of the antenna is isolated from the shielding unit by at least the lengths of the feed unit and the ground unit.

It is contemplated that the first pattern formed between the feed unit and the ground unit of the antenna has a polygonal shape. It is further contemplated that the first pattern between the feed unit and the ground unit of the antenna forms one of a semicircle shape, a triangular shape, and a trapezoidal shape.

It is contemplated that the first pattern of the antenna is wider than the second pattern. It is further contemplated that the first pattern of the antenna operates as a loop antenna, and the second pattern operates as a Planar Inverted-F Antenna (PIFA).

Additional features and advantages of the invention will be set forth in the description which follows, and in part will be apparent from the description, or may be learned by practice of the invention. It is to be understood that both the foregoing general description and the following detailed description of the present invention are exemplary and explanatory and are intended to provide further explanation of the invention as claimed. These and other embodiments will also become readily apparent to those skilled in the art from the following detailed description of the embodiments having reference to the attached figures, the invention not being limited to any particular embodiments disclosed.

BRIEF DESCRIPTION OF THE DRAWINGS

The invention will be described in detail with reference to the following drawings in which like numerals refer to like elements.

DETAILED DESCRIPTION OF THE INVENTION

An antenna and a mobile terminal using the same will now be described in detail with reference to the drawings.

Figure 1:
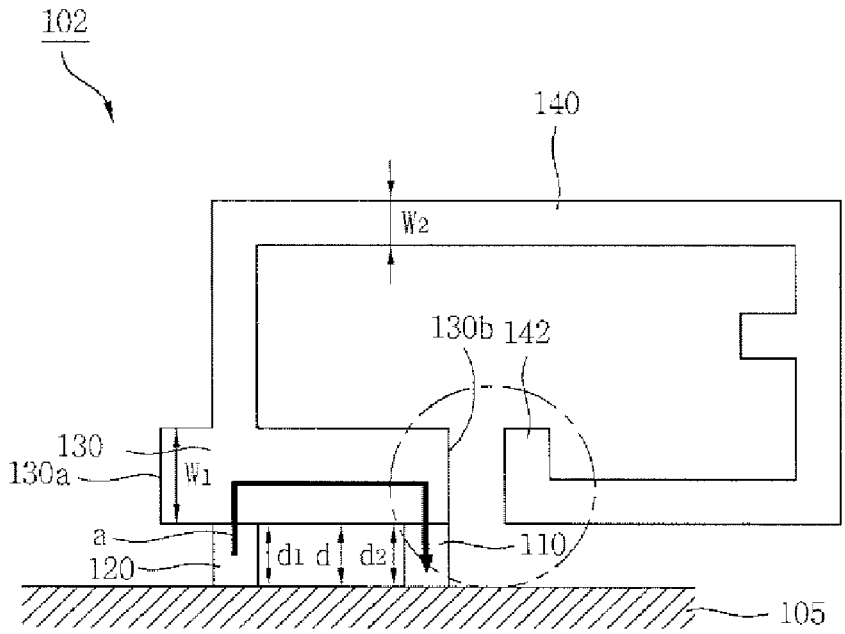
FIG. 1 is a schematic illustrating an antenna according to an embodiment of the present invention.

FIG. 1 is a schematic illustrating an antenna 102 according to an embodiment of the present invention. As illustrated in FIG. 1, an antenna 102 according to an embodiment of the present invention comprises a ground unit 1107 a feed unit 120, a first pattern 130 and a second pattern 140.

The ground unit 110 functions to provide the antenna 102 with a ground path for an electrical signal. In operation of the antenna 102, the feed unit 120 applies the electrical signal to the first pattern 130 and the second pattern 140.

The first pattern 130 has a first end 130*a* connected to the feed unit 120 and a second end 130*b* connected to the ground unit 110. The first pattern 130 is rounded in a loop form in a direction that it is isolated from the shielding unit 105, and has a high frequency band characteristic. The first pattern 130 has a resonant frequency from approximately 1800 MHz to 2000 MHz.

The second pattern 140 is connected to the first end 130*a* of the first pattern 130, and has an open end formed close to the second end 130*b* of the first pattern 130. The second pattern 140 has a low frequency band characteristic. That is, the second pattern 140 has a resonant frequency from approximately 850 MHz to 900 MHz.

The operation of the antenna 102 according to the present invention will be described below.

The ground unit 110 and the feed unit 120 are connected to the shielding unit 105 and adapted to reduce noise introduced into the antenna 102. The ground unit 110 and the feed unit 120 have specific lengths $d_1$ and $d_2$, respectively, and are connected to the first pattern 130. The first pattern 130 has a specific width $w_1$. The first pattern 130 is spaced apart from the shielding unit 105 by a distance "d" that is at least as large as the lengths $d_1$ of the feed unit 120 and $d_2$ of the ground unit 110.

At this time, the first pattern 130 has a loop structure having a current path "a," as illustrated in FIG. 1. The first pattern 130 loop structure fulfills the design condition which is subject to the fact that the pattern length should be about ½ wavelength.

With the first pattern 130 loop structure isolated from the shielding unit 105 as described above, the first pattern has the first end 130*a* to the feed unit 120 and the second end 130*b* connected to the ground unit 110 establishing an electrical characteristic at both ends. Accordingly, the first pattern 130 has a wide band characteristic and is less influenced by peripheral conditions.

Accordingly, the first pattern 130 has a characteristics robust to hand effect in an actual high band. The first pattern 130 has the loop structure, as described above. Therefore, active performance can be improved depending on the separation of the first pattern 130 from the shielding unit 105. For example, since the first pattern 130 is isolated from the shielding unit 105, the formation of an actual electromagnetic field radiated from the antenna 102 is not absorbed on the shielding unit.

The design of the present invention is distinguished from general antenna designs which guarantee the separation between multiple bands to the greatest extent in the case of a multi-band antenna, thereby improving the interference effect with the shielding unit as the distance between the antenna pattern and the shielding unit decreases, and causing a reduction in the active performance incurred by the formation of the field within a close distance. Consequently, an effective radiation characteristic can be improved.

Preferably, as disclosed above, the antenna first pattern 130, i.e., the start end of the feed unit 120 and the first pattern having the greatest current distribution, is positioned away from the shielding unit 105. Accordingly, the formation of field current at this portion is less hindered by the shielding unit 105. If the distance between the shielding unit 105 and the radiation source is minimized as described above, then the losses for an active antenna radiation output can be minimized regardless of the passive performance of the antenna 102, thereby resulting in improved radiation efficiency.

The first pattern 130 has a first end 130*a* connected to the second pattern 140. The second pattern 140 has an end 142 formed close to a portion of the second end 130*b* of the first pattern 130 that is connected to the ground unit 110, therefore it is PIFA structure and the second pattern has a low frequency band characteristic.

The width $w_2$ of the second pattern 140 is narrower than the width $w_1$ of the first pattern 130. This is because the first pattern 130 has a high frequency band characteristic, and must have a band wide enough to cover a Digital Cellular System (DCS), a Personal Communications Services (PCS), and Wideband Code Division Multiple Access (WCDMA) 2100.

The second pattern 140 shares the feed unit 120 supply via loop structure of the first pattern 130, and fulfills the ¼ wavelength condition for a short antenna having one end connected to both the feed line and the short line (connected to ground of the circuit), and another end unconnected, so called inverted-F antenna (IFA). The second pattern 140 begins at the loop structure of the first pattern 130. Therefore, the second pattern 140 includes both the feed unit 120 and the ground unit 110 of the first pattern 130 loop structure. Accordingly, the second pattern 140 becomes a PLANAR INVERTED-F ANTENNA (PIFA) structure.

By using the structure in which the antenna 102 loop structure and the PIFA structure are mixed, the performance can be improved through the loop structure in a high band, and an implemented area can be minimized using the PIFA structure in a low band.

The end 142 of the second pattern 140 is formed close to the portion of the first pattern 130 which is connected to the ground unit 110, thus forming coupling. The term "coupling" refers to a phenomenon caused by the ends of the high frequency band and the low frequency band having closely positioned structures, wherein there is expansion of the high frequency band and the low frequency band and a center frequency of a high band frequency moves, such that the frequency moves to a desired band through adequate tuning.

The band can be expanded using a parasitic element grounded in the PIFA structure. A small frequency movement characteristic is obtained along with such band expansion. By combining these theories, a desired bandwidth and a desired resonant frequency can be obtained through tuning.

In the above embodiment, it has been described that a portion in which the antenna first pattern 130 is connected to the feed unit 120 and the ground unit 110 forms a straight line, and has the same length d as the lengths $d_1$ and $d_2$ of the feed unit 120 and the ground unit 110. However, the present invention is not limited to the above embodiment, but may include various alternative embodiments, as illustrated in FIGS. 2-4.

Figure 2:
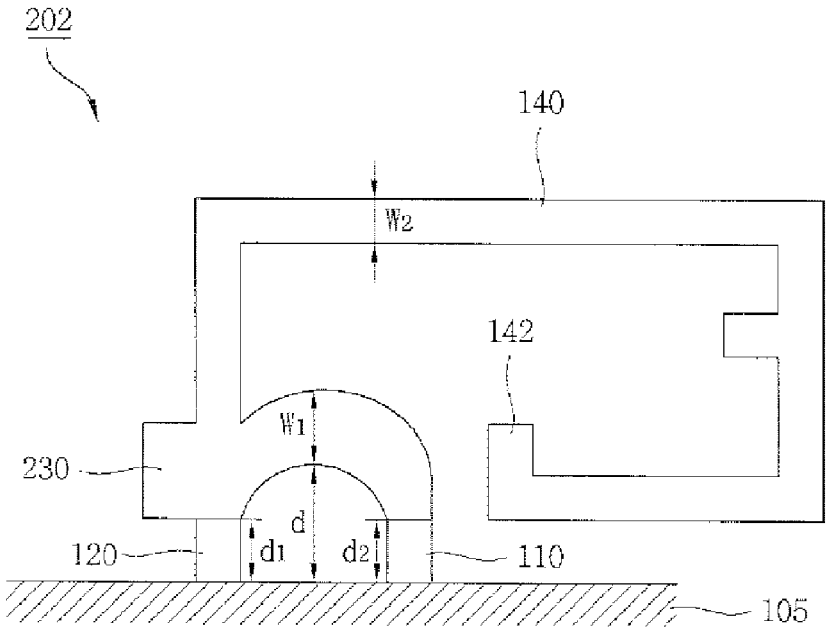
FIG. 2 is a schematic illustrating an antenna according to another embodiment of the present invention.
Figure 3:
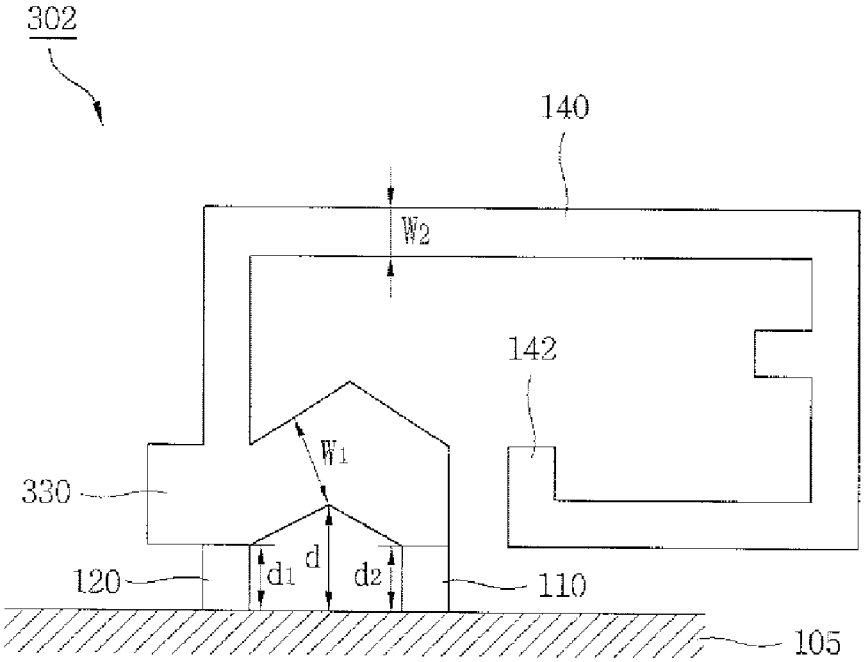
FIG. 3 is a schematic illustrating an antenna according to another embodiment of the present invention.
Figure 4:
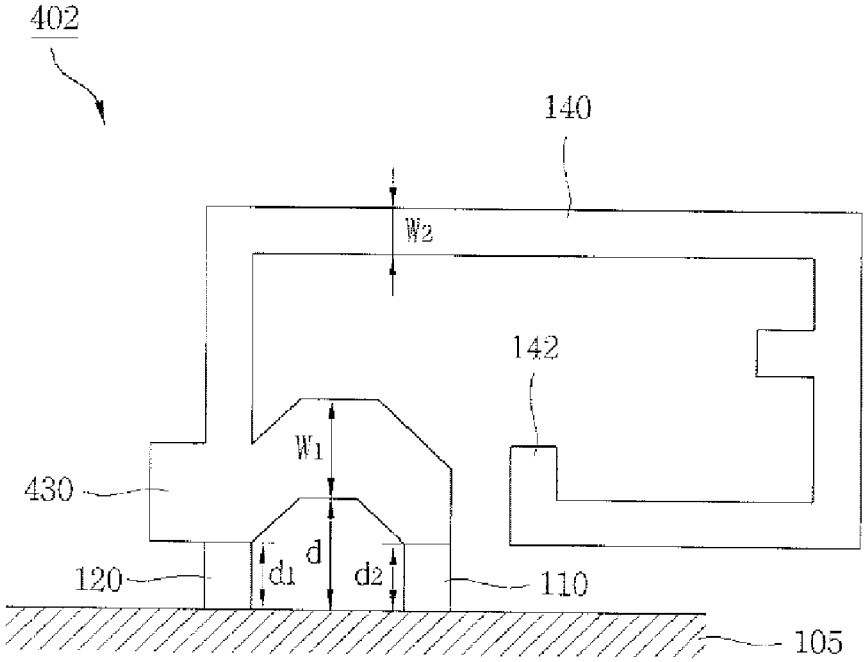
FIG. 4 is a schematic illustrating an antenna according to another embodiment of the present invention.

As illustrated in FIGS. 2-4, all the structures and operational characteristics of the antenna 102 except for the shape of the first pattern 130 are the same as those described with respect to FIG. 1 and will not be described in detail.

FIG. 2 is a schematic illustrating an antenna 202 according to another embodiment of the present invention. As illustrated in FIG. 2, the shape of the first pattern 230 between the feed unit 120 and the ground unit 110 can be a semicircle.

As the pattern between the feed unit 120 and the ground unit 110 in the first pattern 230 forms the semicircle shape, the first pattern 230 is further isolated from the shielding unit 105 more than the lengths $d_1$ of the feed unit 120 and $d_2$ of the ground unit 110. The first pattern 230 is further isolated from the shielding unit 105, therefore an actual active performance, such as an effective output or an effective sensitivity, can be further improved.

FIG. 3 is a schematic illustrating an antenna 302 according to another embodiment of the present invention. As illustrated in FIG. 3, the shape of the first pattern 330 between the feed unit 120 and the ground unit 110 can be triangular.

The first pattern 330 is further isolated from the shielding unit 105 more than lengths $d_1$ of the feed unit 120 and $d_2$ of the ground unit 110, when the shape of the first pattern between the feed unit 120 and the ground unit 110 forms the triangular shape.

FIG. 4 is a schematic illustrating an antenna 402 according to another embodiment of the present invention. As illustrated in FIG. 4, the shape of the first pattern 430 between a feed unit 120 and a ground unit 110 is a semi-trapezoid. Accordingly, the first pattern 430 can be further isolated from the shielding unit 105 by more than lengths $d_1$ of the feed unit 120 and $d_2$ the ground unit 110.

Figure 5:
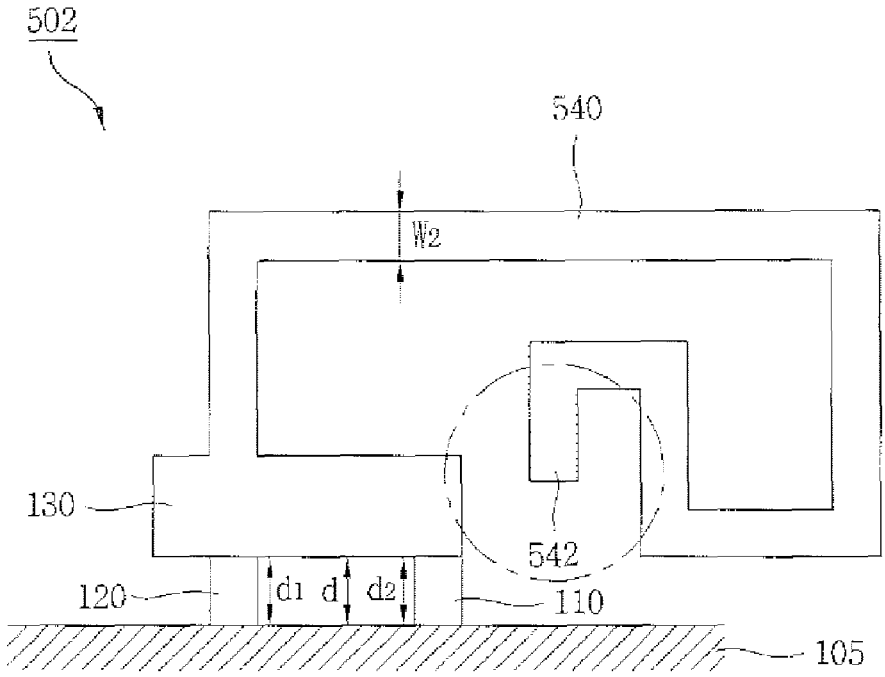
FIG. 5 is a schematic illustrating an antenna according to another embodiment of the present invention.

FIG. 5 is a schematic illustrating an antenna 502 according to another embodiment of the present invention. As illustrated in FIG. 5, the second pattern 540 includes a winding open end structure. The second pattern 540 has an open end 542 formed close to a portion of the first pattern 130 which is connected to the ground unit 110. The second pattern 540 and the first pattern 130 are coupled with the feed unit as described previously. However, by forming the second pattern 540 in the winding structure, the antenna 502 can be further miniaturized.

All of the design aspects of antenna 102-502, as disclosed above, can be mounted in a mobile terminal 100.

Figure 6:
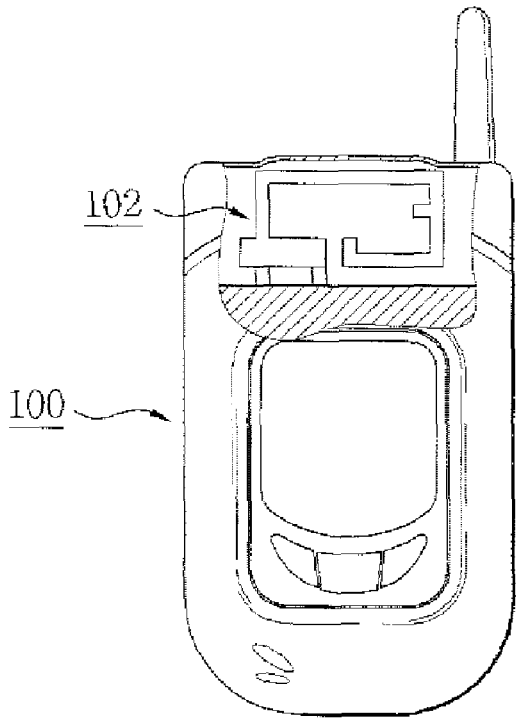
FIG. 6 illustrates a mobile terminal comprising the antenna according to an embodiment of the present invention.

FIG. 6 illustrates a mobile terminal 100 comprising an antenna 102 according to an embodiment of the present invention. As illustrated in FIG. 6, the antenna 102 can be mounted in the mobile terminal 100.

For example, the shielding unit 105 is installed in order to reduce noise induced into the antenna 102 from a main circuit (not shown) or to protect the main circuit from the antenna 102.

The shielding unit 105 can generally use a camera shielding structure (not shown). The camera shielding structure is connected to a ground surface of the mobile terminal 100, thus forming a ground surface path.

The radiation output of the antenna 102 when mounted in the mobile terminal 100, as disclosed above, will be described with reference to FIG. 7.

Figure 7:
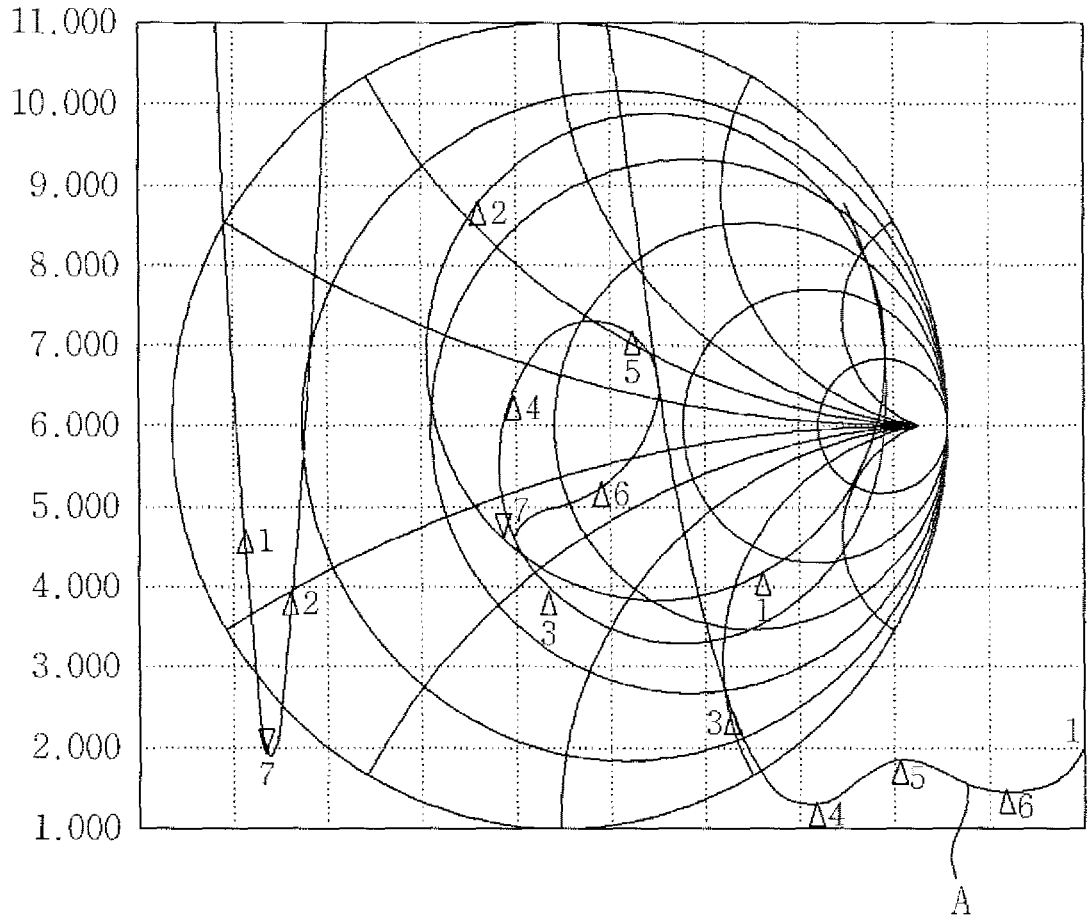
FIG. 7 illustrates the measurements of radiation outputs of the antenna according to an embodiment of the present invention.

FIG. 7 illustrates the radiation output measurements of the antenna 102 according to an embodiment of the present invention. From FIG. 7, it can be seen that frequency response characteristics measured using a network analyzer of the antenna 102 according to an embodiment of the present invention covers all GSM900, DCS, PCS, and WCDMA2100 bands. At this time, resonance is good and the antenna efficiency is increased below a line A.

The total radiation output power of the antenna 102 will be described with reference to Table 1.

TABLE 1

| | Before pattern isolated | After pattern isolated |
|---|---|---|
| WCDMA2100 | 15.96 | 16.53 |
| GSM900 | 17.67 | 24.052 |

From Table 1, it can be seen that the radiation output is improved by about 0.5 dB in the WCDMA band after the pattern is isolated compared with before the pattern was isolated, and the GSM900 band is improved by about 6.5 dB. In particular, the GSM900 band has been significantly improved, because the pattern of the antenna 102 is isolated from the shielding unit 105 operating as the ground surface.

The shape of the first pattern 130 is not limited to the shapes described in the above embodiments, but may include all polygonal shapes. Accordingly, the first pattern 130 can be further isolated from the shielding unit 105, thus improving the characteristics of the antenna 102.

As described above, the present invention has the following advantages.

First, by using a new structure in which the loop structure and the PIFA structure are combined, the performance can be improved through the loop structure in a high band, and an implementation area can be minimized through the PIFA structure in a low band.

Second, in the shielding unit, the feed unit is located away from a point with large current distributions. Therefore, it is possible to easily improve active antenna performance.

Third, the end of the low frequency band is formed close to the ground unit of the high frequency band, and coupled thereto. Accordingly, there are advantages in that a wider bandwidth and a desired resonant frequency can be obtained easily.

Fourth, there are advantages in that the hand effect and the effective performance can be improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A mobile terminal, comprising:

a shielding unit; and an antenna comprising a feed unit and a ground unit formed over the shielding unit, a first pattern of the antenna having a first end connected to a top surface of the feed unit and a second end connected to the ground unit and isolated from the shielding unit, and a second pattern of the antenna connected to the first end of the first pattern and having an open end formed close to the second end of the first pattern;

wherein the first pattern has a high frequency band characteristic and the second pattern has a low frequency band characteristic, and wherein the feed unit and the ground unit are spaced apart from each other.

2. The mobile terminal of claim 1, wherein a current applied from the feed unit of the antenna flows through the first pattern in a loop structure to the ground unit.

3. The mobile terminal of claim 1, wherein the first pattern is isolated from the shielding unit by at least respective lengths of the feed unit and the ground unit.

4. The mobile terminal of claim 1, wherein a portion of the first pattern formed between the feed unit and the ground unit has a polygonal shape.

5. The mobile terminal of claim 1, wherein the first pattern of the antenna is wider than the second pattern.

6. The mobile terminal of claim 1, wherein the first pattern operates as a loop antenna having a loop structure, and the second pattern operates as a Planar Inverted-F Antenna (PIFA) which has a feeding part and a short part to ground originating from the loop structure.

7. The mobile terminal of claim 1, wherein the shielding unit reduces noise induced from a main circuit to the antenna.

8. The mobile terminal of claim 1, wherein a portion of the first pattern between the feed unit and the ground unit forms one of a semicircle shape, a triangular shape, and a trapezoidal shape.

9. The mobile terminal of claim 8, wherein the second pattern forms an open end winding structure close to a portion of the second end of the first pattern.

10. The mobile terminal of claim 1, wherein a portion of the first pattern between the feed unit and the ground unit forms a rectangular shape, and the second pattern forms an open end winding structure close to a portion of the second end of the first pattern.

11. An antenna adapted to reduce the effect of noise in a mobile terminal, the antenna comprising:

a shielding unit;

a feed unit and a ground unit formed over the shielding unit;

a first pattern having a first end connected to a top surface of the feed unit and a second end connected to the ground unit and isolated from the shielding unit; and a second pattern connected to the first end of the first pattern and having an end formed close to a portion of the second end of the of the first pattern;

wherein the first pattern has a high frequency band characteristic and the second pattern has a low frequency band characteristic, and wherein the feed unit and the ground unit are spaced apart from each other.

12. The antenna of claim 11, wherein a current applied from the feed unit has a loop structure in which the current flows to the ground unit through the first pattern.

13. The antenna of claim 11, wherein the first pattern is isolated from the shielding unit by at least respective lengths of the feed unit and the ground unit.

14. The antenna of claim 11, wherein a portion of the first pattern between the feed unit and the ground unit has a polygonal shape.

15. The antenna of claim 11, wherein the first pattern is wider than a width of the second pattern.

16. The antenna of claim 11, wherein the first pattern operates as a loop antenna, and the second pattern operates as a Planar Inverted-F Antenna (PIFA).

17. The antenna of claim 11, wherein a portion of the first pattern between the feed unit and the ground unit forms one of a semicircle shape, a triangular shape, and a trapezoidal shape.

18. The antenna of claim 17, wherein the formed shape of the portion of the first pattern further isolates the first pattern from the shielding unit and improves an effective output of the antenna.

19. The antenna of claim 17, wherein the second pattern forms an open end winding structure close to a portion of the second end of the first pattern.

20. The mobile terminal of claim 11, wherein a portion of the first pattern between the feed unit and the ground unit forms a rectangular shape, and the second pattern forms an open end winding structure close to a portion of the second end of the first pattern.

* * * * *